US008950022B2

(12) United States Patent
Chen

(10) Patent No.: US 8,950,022 B2
(45) Date of Patent: Feb. 10, 2015

(54) MATTRESS-BEARING HOSPITAL BED

(71) Applicant: Hui-Mei Chen, New Taipei (TW)

(72) Inventor: Hui-Mei Chen, New Taipei (TW)

( * ) Notice: Subject to any disclaimer, the term of this patent is extended or adjusted under 35 U.S.C. 154(b) by 0 days.

(21) Appl. No.: 13/903,058

(22) Filed: May 28, 2013

(65) Prior Publication Data

US 2014/0352066 A1 Dec. 4, 2014

(51) Int. Cl.

| | |
|---|---|
| ***A47C 27/00*** | (2006.01) |
| ***A47B 71/00*** | (2006.01) |
| ***A47C 17/00*** | (2006.01) |
| ***A61G 7/00*** | (2006.01) |

(52) U.S. Cl.

CPC .. *A61G 7/00* (2013.01); *Y10S 5/922* (2013.01); *Y10S 5/925* (2013.01)

USPC ..... 5/411; 5/922; 5/600; 5/925; 5/690; 5/400

(58) Field of Classification Search

USPC ..... 5/637, 600, 421, 652, 690, 925, 922, 5/400, 411

See application file for complete search history.

*Primary Examiner* — Peter M Cuomo
*Assistant Examiner* — Brittany Wilson
(74) *Attorney, Agent, or Firm* — Ming Chow; Sinorica, LLC

(57) ABSTRACT

A mattress-bearing hospital bed comprises a hospital bed body on which a plurality of hook-and-loop fasteners are installed and a mattress structure which comprises a silicone layer with straight grooves thereon, a polyurethane film covering the silicone layer, and a velvet fabric layer whose one surface is melt to the plane bottom of the polyurethane film covering the silicone layer and other surface contacts the hospital bed body by means of the hook-and-loop fasteners in order to attach the mattress structure to the hospital bed body.

1 Claim, 5 Drawing Sheets

MATTRESS-BEARING HOSPITAL BED

BACKGROUND OF THE INVENTION

1) Field of the Invention

The present invention relates to a mattress-bearing hospital bed, particularly a hospital bed on which a mattress structure made of a TPU (polyurethane) film, silicone material, and a velvet fabric layer is developed.

2) Description of the Prior Art

In general, a mattress should be spread out on a hospital bed (operating table or sickbed) on which a patient lies for his (her) comfort. However, a mattress structure placed on an operating table or a sickbed has a flat surface causing poor friction between the operating table or the sickbed and the mattress structure on which a patient lies and further slips downward so that the patient experiences uncomfortable feeling; furthermore, an ultra-flat mattress structure at an operating table or a sickbed on which a patient lies may have poor air permeability that causes the patient to feel hot, itchy or uncomfortable in addition to above drawbacks.

A mattress structure horizontally placed on an operating table or a sickbed which is designed to be folded partially in order to match multiple situations of patients is inadequately folded or deformed and unavailable for the operating table or the sickbed which has been folded.

Accordingly, a hospital bed provided with a mattress structure on which straight grooves are developed will become an easily folded bed and is referred to as an optimal solution because the straight grooves thereon provides enough air permeability for a patient who lies on the hospital bed and feels nothing uncomfortable such as heat and itch when his (her) back contacts the straight grooves.

SUMMARY OF THE INVENTION

The present invention presents a mattress-bearing hospital bed providing enough space through which body heat of a patient, who lies on the hospital bed's mattress structure with various advantages such as excellent buffering effect, superior serviceability, fine touch impression and good softness, is dissipated.

The mattress-bearing hospital bed realizing the above purposes comprises: a hospital bed body on which a plurality of hook-and-loop fasteners are installed; a mattress structure comprising a silicone layer with a plane surface in bottom side and a top surface on which straight grooves are developed; a polyurethane film completely covering the silicone layer and further the silicone layer's plane bottom along the straight grooves on the silicone layer's top surface; a velvet fabric layer with two surfaces: one surface melt to the plane bottom of the polyurethane film which covers the silicone layer and the other making the velvet fabric layer attach to the hospital bed body by means of the hook-and-loop fasteners on the hospital bed body.

Specially, the silicone layer is made of liquid silicone gel or liquid silicone rubber.

Specially, the velvet fabric layer has a brushed fleece surface used to contact the hospital bed body.

Specially, the hospital bed body can be an operating table or a sickbed.

BRIEF DESCRIPTIONS OF THE DRAWINGS

The objects, spirits, and advantages of the preferred embodiments of the present invention will be readily understood by the accompanying drawings and detailed descriptions, wherein.

DETAILED DESCRIPTIONS OF THE PREFERRED EMBODIMENTS

The above and other detailed contents, features and effects with respect to the present invention are clearly presented in the following preferred embodiments and accompanying drawings.

Figure 1A:
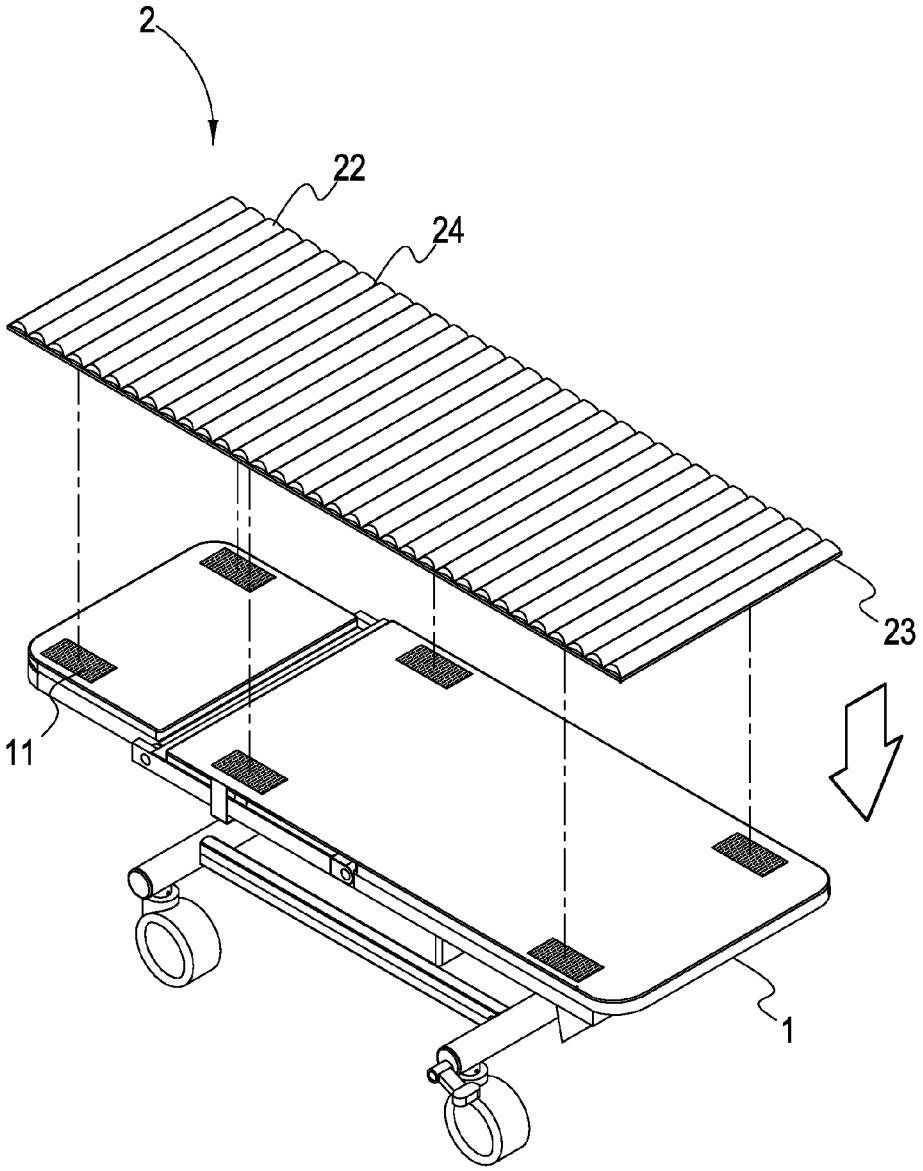
FIG. 1A is a perspective exploded view for the present invention of a mattress-bearing hospital bed.
Figure 1B:
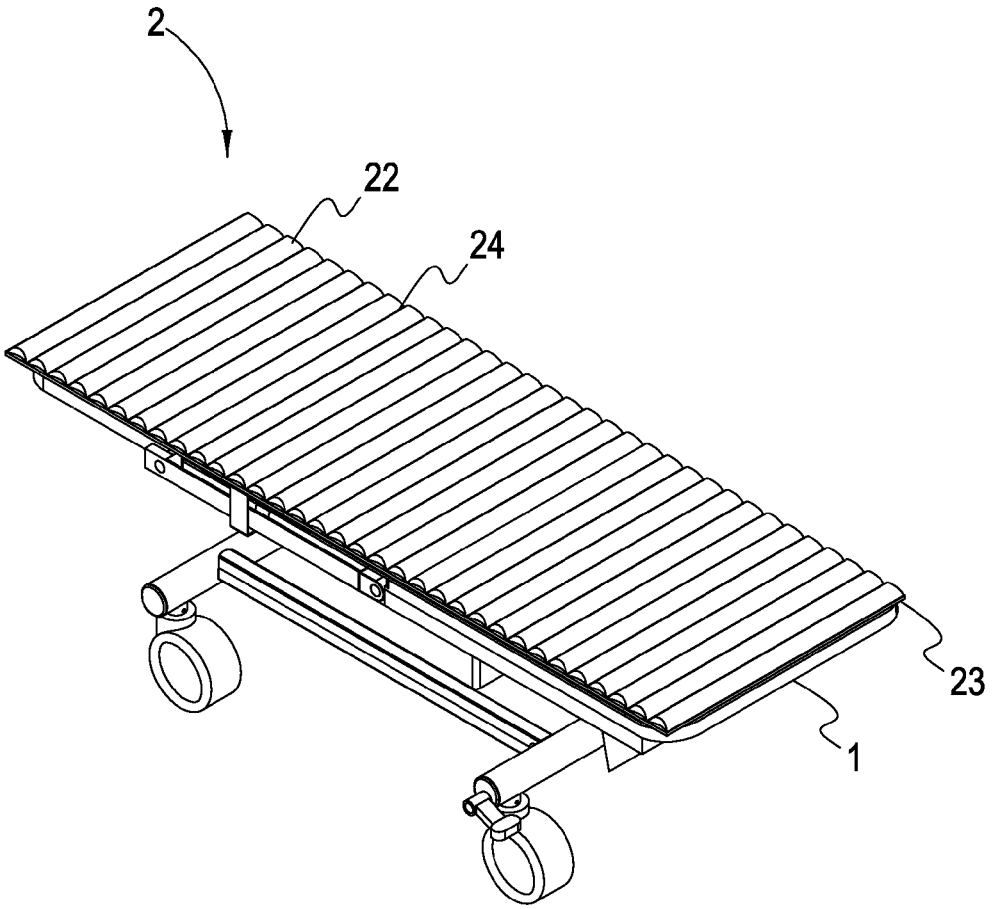
FIG. 1B is a perspective view of the present invention of a mattress-bearing hospital bed which is assembled.
Figure 2A:
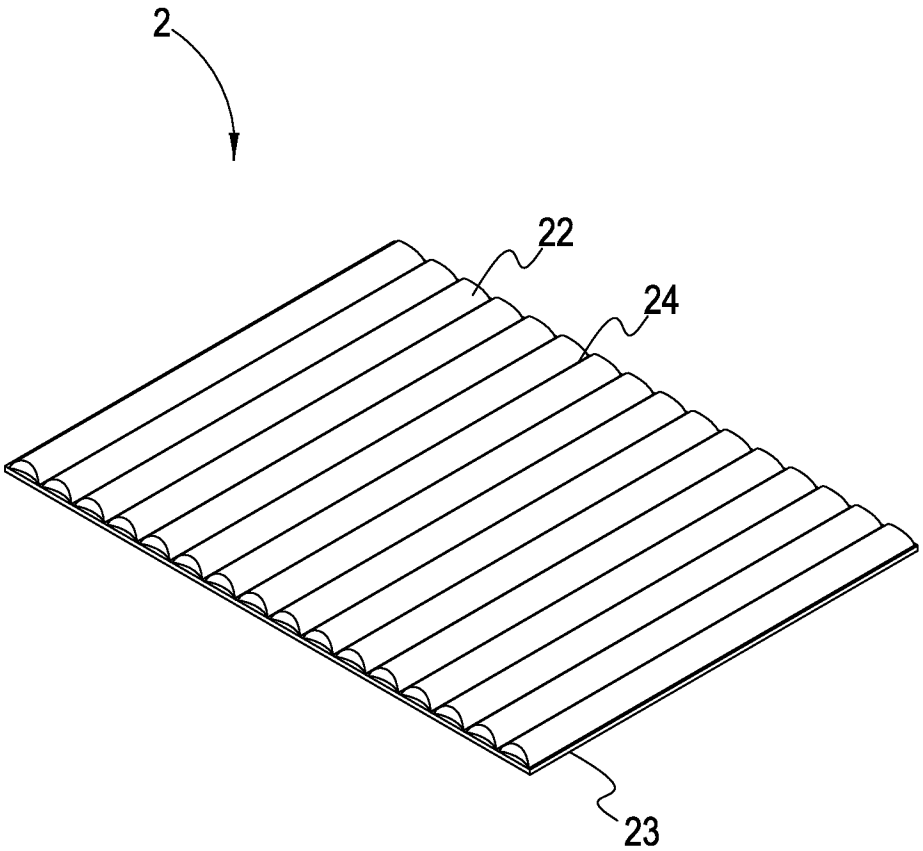
FIG. 2A is a schematic view of a mattress structure in the present invention of a mattress-bearing hospital bed.
Figure 2B:
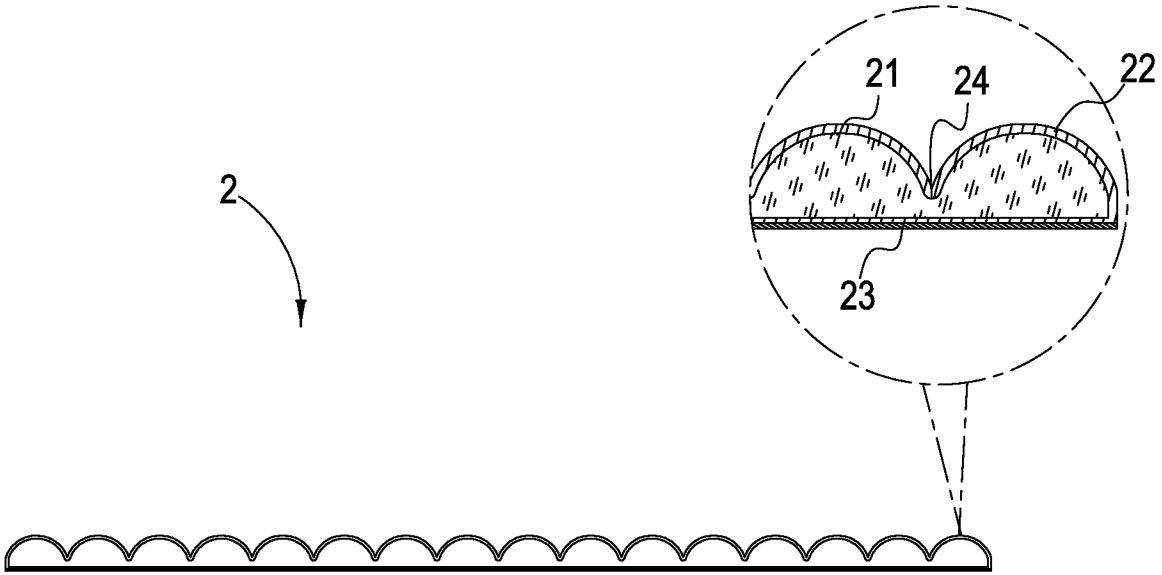
FIG. 2B is a sectional view of a mattress structure in the present invention of a mattress-bearing hospital bed.

Referring to FIGS. 1A and 1B which are an exploded view and a perspective view for the present invention of a mattress-bearing hospital bed, respectively. It can be seen from FIGS. 1A and 1B that a hospital bed body 1 is provided with a plurality of hook-and-loop fasteners 11 and comprises a mattress structure 2 attached to the hospital bed body 1 for development of a mattress-bearing hospital bed. As shown in FIGS. 2A and 2B, the mattress structure 2 comprises a silicone layer 21 (liquid silicone gel or liquid silicone rubber), a polyurethane film (TPU film) 22 and a velvet fabric layer 23: the silicone layer 21 has a plane surface in bottom side and a top surface on which straight grooves 24 are developed; the polyurethane film 22 completely covers the silicone layer 21 and further the plane bottom of the silicone layer 21 along the straight grooves 24 on the top surface of the silicone layer 21 whose silicon material wrapped by the polyurethane film 22 softens the mattress structure 2 and is not exposed to ambient environment.

The velvet fabric layer 23 has two surfaces: one surface facing the polyurethane film 22 is melt to the plane bottom of the polyurethane film 22; the other one faces and joins the hospital bed body 1 with a plurality of hook-and-loop fasteners 21 by which the velvet fabric layer 23 allows its other surface to adhere to the hospital bed body 1, an operating table or a sickbed, and enhances non-slip effect of the hospital bed body 1.

Figure 3:
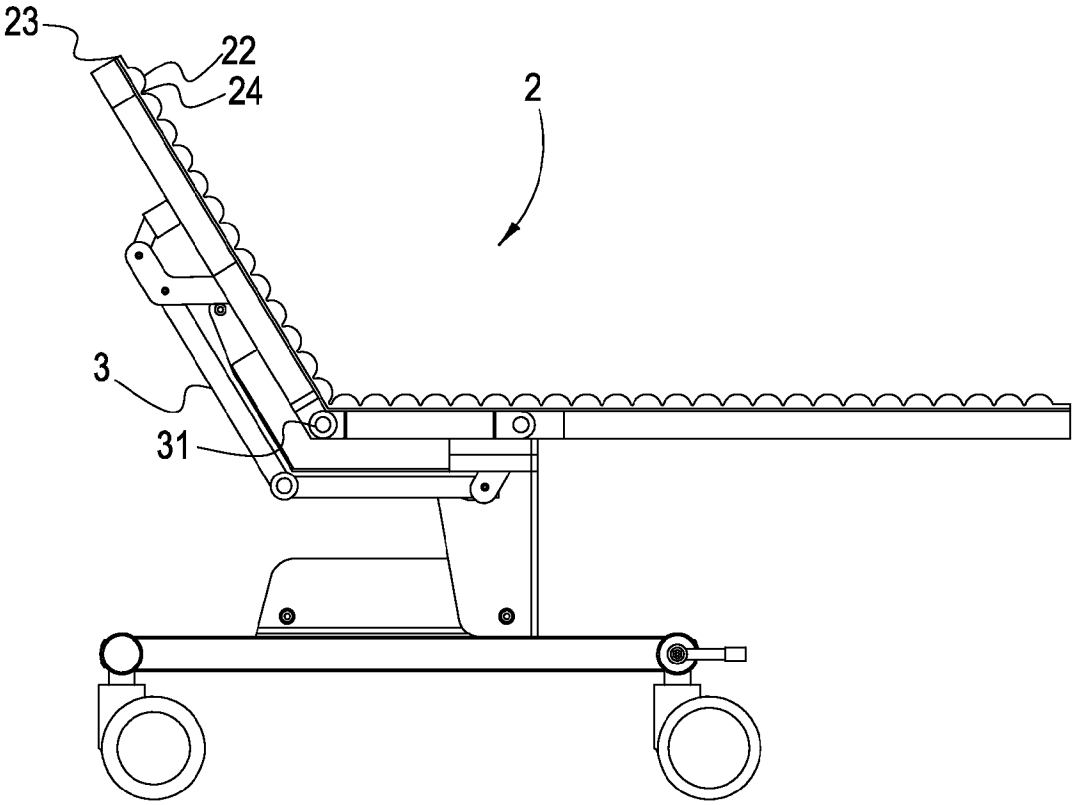
FIG. 3 is a schematic view for the present invention of a mattress-bearing hospital bed which is folded in operation.

The mattress structure 2 relying on the straight grooves 24 thereon is easily folded and adheres to any inclined plane. As shown in FIG. 3, the hospital bed body 1 is an automated fold-out bed 3 lifted partially and developing a foldable part 31 by which the mattress structure 2 is positioned along the straight grooves 14 on an undulate plane without any bulge or deformation of the mattress structure 2. In addition to its shape easily changed via the straight grooves 24, the mattress structure 2 features its air permeability and heat dissipation superior to those of other conventional mattress structures because body heat of a patient, who lies on the mattress structure 2 and makes skin contact the straight grooves 24, is dissipated from the straight grooves 24 which develop a plurality of continuous indentations thereon. As such, the mattress structure 2 is effective in preventing a patent having lain on a sickbed for a long period from discomfort.

The present invention presenting a mattress-bearing hospital bed has some advantages in contrast to other hospital beds based on the prior art:

The present invention of a hospital bed which comprises a mattress structure features various advantages such as excellent comfort, superior air permeability, good heat dissipation, fine buffering effect, and flexible size; the hospital bed which is adjusted to a specific angle allows the folded mattress structure thereon to change its shape and optimizes a patient's comfort.

The preferred embodiments disclosed hereinbefore are intended for elaborating characteristics and spirit of the present invention but do not limit the present invention. Moreover, any equivalent change or arrangement should be covered in claims of the present invention.

What is claimed is:

1. A mattress-bearing hospital bed, comprising:

a hospital bed body on which a plurality of hook-and-loop fasteners are installed;

a mattress structure, comprising:

a silicone layer with a plane surface in bottom side and a top surface on which straight grooves are developed;

said silicone layer being made of liquid silicone gel or liquid silicone rubber;

a polyurethane film which completely covers said silicone layer and further said silicone layer's plane bottom along said straight grooves on said silicone layer's top surface;

a velvet fabric layer with two surfaces: one surface is melt to said plane bottom of said polyurethane film which covers said silicone layer; the other surface makes said velvet fabric layer attach to said hospital bed body by means of the hook-and-loop fasteners on said hospital bed body;

said velvet fabric layer has a brushed fleece surface used to contact said hospital bed body; and said hospital bed body can be an operating table or a sickbed.

* * * * *